United States Patent [19]

Patterson

[11] 3,995,393

[45] Dec. 7, 1976

[54] MODEL GLIDER AND METHOD OF FLYING

[76] Inventor: Douglas Edward Patterson, 5125 Williams Fork Trail No. 205, Boulder, Colo. 80301

[22] Filed: Nov. 10, 1975

[21] Appl. No.: 630,559

[52] U.S. Cl. ..... 46/79; 46/76 R

[51] Int. Cl.[2] ..... A63H 27/00

[58] Field of Search ..... 46/76 R, 76 A, 77, 78, 46/79, 80, 81

[56] References Cited

UNITED STATES PATENTS

| | | | |
|---|---|---|---|
| 1,400,097 | 12/1921 | Perkins | 46/79 |
| 2,454,598 | 11/1948 | Doyle | 46/76 R |
| 2,539,357 | 1/1951 | Wald | 46/76 R |
| 2,597,521 | 5/1952 | Pemberton | 46/81 |
| 3,920,201 | 11/1975 | Battles | 46/79 |

*Primary Examiner*—Louis G. Mancene
*Assistant Examiner*—Robert F. Cutting
*Attorney, Agent, or Firm*—Thomas W. O'Rourke

[57] ABSTRACT

Model glider including means for controlling the pitch attitude of the glider between alternative launch and glide configurations and timing means to programmably reconfigure the glider from the launch to the glide configuration a preselected period of time after launching the glider. Also a method in which the glider is launched having substantial kinetic energy with the pitch control in the launch position and, as the kinetic energy diminishes and the glider starts through the top of an arc, the pitch attitude control means is reconfigured to the glide configuration to provide a stable transition to an effective angle of attack for elongated glides. In a particularly preferred embodiment, the timing device includes a distendable member having an elastic memory.

11 Claims, 13 Drawing Figures

10
12
13
15
17
18
20
22
27
28
30
31
33
35
40
46
50
52
A

MODEL GLIDER AND METHOD OF FLYING

BACKGROUND OF THE INVENTION

1. Field of the invention

The present invention relates generally to hand or catapult launched model gliders, and more particularly to structure and method providing both an efficient launch phase when the glider has relatively high kinetic energy and velocity, and an efficient and effective, but differing, glide phase when the glider has attained maximum potential energy at a low velocity.

2. Description of the Prior Art

The conventional hand or catapult launched model glider undergos two distinct and substantially incompatible phases of flight. When first launched, the glider has substantial velocity and accodingly operates most effectively with the wings at a relatively low angle of attack and a relatively low angle of incidence between the wings and pitch attitude control surface to permit the glider to gain altitude in a substantially arcuate manner. As the glider gains altitude, the speed diminishes and the lift of the wings accordingly diminishes to generate the arcuate path of travel. However, as the glider goes through the top of the arc and returns to a level configuration, the kinetic energy has largely dissipated while the potential energy of the glider is at a maximum. At this point, a relatively high angle of attack of the lifting surface as a result of an increased angle of incidence between the wing and pitch attitude control surface is required in order to provide an optimum glide. Essentially, this requires the lifting surface to be more effective a relatively low speeds as the model glides back to Earth.

Conventionally, the two phases have been compromised such that a glider launched vigorously will promptly perform an inside loop and, in most cases, terminate flight either directly or after stalling. On the other hand, a more gently launched conventional glider will gain but modest altitude and glide in a less than optimum fashion from such modest altitude.

Another approach involves gliders with spring loaded, or otherwise biased folding wings which lay back along the fuselage in the launch configuration. The glider is catapulted by, for instance, sturdy rubber bands with the aerodynamic forces holding the wings in a folded position. When the kinetic energy is expended, the glider slows and the lessened aerodynamic forces permit the wings to unfold into a glide configuration. However, it will be recognized that the transition is one from an unstable projectile to a gliding aerodynamic device thus requiring a substantial transition. This transition is not only in itself inefficient, but also contributes in most cases to a series of dives and overcorrecting climbs which provide an inefficient gliding mode.

The Jacobs U.S. Pat. No. 2,034,143 and Stark U.S. Pat. No. 2,588,941 describe a concept which is, on the surface, more appealing. This concept involves a pitch attitude control device—such as an elevator—which is positioned as a function of the glider velocity and accordingly of the glider speed produced aerodynamic force on the elevator. Thus, when first launched, the aerodynamic force at high airspeed maintains the elevator in a rather efficient configuration for a low angle of attack of the lifting surface. However, as the glider moves upward, the speed of the glider diminishes and the angle of attack is constantly increased as the air speed controlled elevator moves to a fully upward position. Accordingly, as the kinetic energy of the launch is expended, the glider is maintained in a noseup attitude with full up elevator applied as a result of the essentially zero velocity through the air. This of course is the classical stall configuration. Thus, as the effectiveness of the lifting surface fails with diminished velocity, the glider stalls and falls into a largely nose-down position and gains speed, until the lifting surface again becomes effective and, induces the glider to assume a greater and greater nose-up attitude. Again, at the time the nose or pitch configuration is optimum, the air speed tends to be relatively low and the elevator again overcorrects in an unsteady equilibrium by forcing the nose of the glider higher and higher while the airspeed gets lower and lower. Thus, classically, gliders having air speed controlled elevator surfaces display an efficient initial launch phase, but are subject to an inefficient and unstable transition into the glide phase. Rather than assuming a steady and optimum glide, such gliders tend to undergo a series of oscillations between diving and stalling in an attempt to reach equilibrium in the form of a steady glide.

SUMMARY OF THE INVENTION

The present invention, which provides a heretofore unavailable improvement over previous hand launched or catapulted gliders, comprises a glider having a lightweight timing device which, as a step function after a predetermined period of time, transitions the glider from an efficient launch phase to an efficient glide phase. The method involves vigorously launching the glider in the launch configuration and, upon launching, releasing or tripping the timing device. Then, it is a relatively simple matter to establish the time period of the climb and, accordingly, to adjust the timing device to transition the glider from the launch configuration to the glide configuration at the time the nose of the glider rotates from a slight upward attitude to a mild downward attitude.

Accordingly, an object of the present invention is to provide a new and improved glider design and method which provides for improved and longer glider flights.

Another object of the present invention is to provide a new and improved glider structure and method providing for multi phase flight configurations essentially independent of the air speed of the glider at any given time.

Yet another object of the present invention is to provide a new and improved glider structure and method which avoids instability and, thus, attains efficient energy management as the glider transitions from a launch configuration to a glide configuration.

Still another object of the present invention is to provide for a new and improved glider structure and method which permits preselected optimum glide rate configuration and attitude of the glider during descent to be attained.

Yet still another object of the present invention is to provide a new and improved glider structure and method which utilizes a unique, simple and lightweight timing device.

These and other objects and features of the present invention will become apparent from the following descriptions.

DETAILED DESCRIPTION OF THE INVENTION

Figure 1:
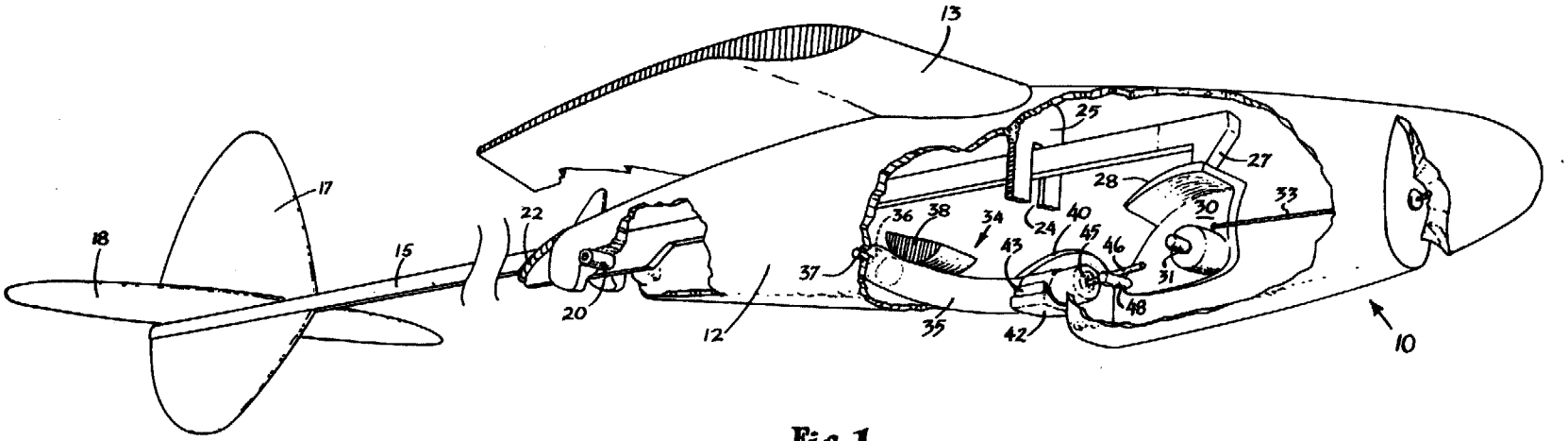
FIG. 1 is a partially cutaway, perspective view of a preferred embodiment of a glider in accordance with the present invention.

Turning now to the drawings, wherein like components are designated by like reference numerals throughout the various figures, a glider in accordance with the present indication is illustrated in FIG. 1 and generally designated by reference numeral 10. Glider 10 is comprised of fuselage 12 having attached thereto wings 13 and pitch attitude control boom 15. At the end of attitude control boom 15 are vertical stabilizer 17 and horizontal stabilizer 18. Pitch attitude control boom 15 is secured to fuselage 12 at pivot 20 and biased into a "tailup" position by biasing means 22 in the form of an elastic band. Vertical slot 24 defined by projections 25 locate pitch attitude boom 15 internally of fuselage 12. Follower 27 depends from the end of pitch attitude control boom 15 and rests upon release surface 28 of actuating means 30 attached to fuselage 12 around pivot rod 31. Positioning means 33, in the form of an elastic member tends to rotate activation means 30 around pivot rod 31 such that follower 27 rests on release surface 28. Timer 34, such as distendable member 35, which may be a simple neoprene tube or other substance having an elastic memory, is mounted in fuselage 12 adjacent activation means 30 by means of plug 36 in distendable member 35 and receiving locating pin 37 extending through distendable member 35 and plug 36 and into fuselage 12. Fulcrum 38 is supported by fuselage 12 between mounting pin 37 and activation means 30. Distendable member 35 extends through open notch 40 defined in fuselage 12 at which point block 42 is attached to distendable member 35 by means of, for example, adhesive strip 43.

Plug 45 is positioned in one end of distendable member 35 and carries small shaft 46 which extends axially from distendable member 35. Small shaft 46 is oriented to contact engagement member 48 projecting from activation means 30 when distendable member 35 is in a relaxed position.

The operation of glider 10 and method of flight will be more readily understood with reference to FIGS. 2 through 5.

Figures 2, 3, 4, 5:
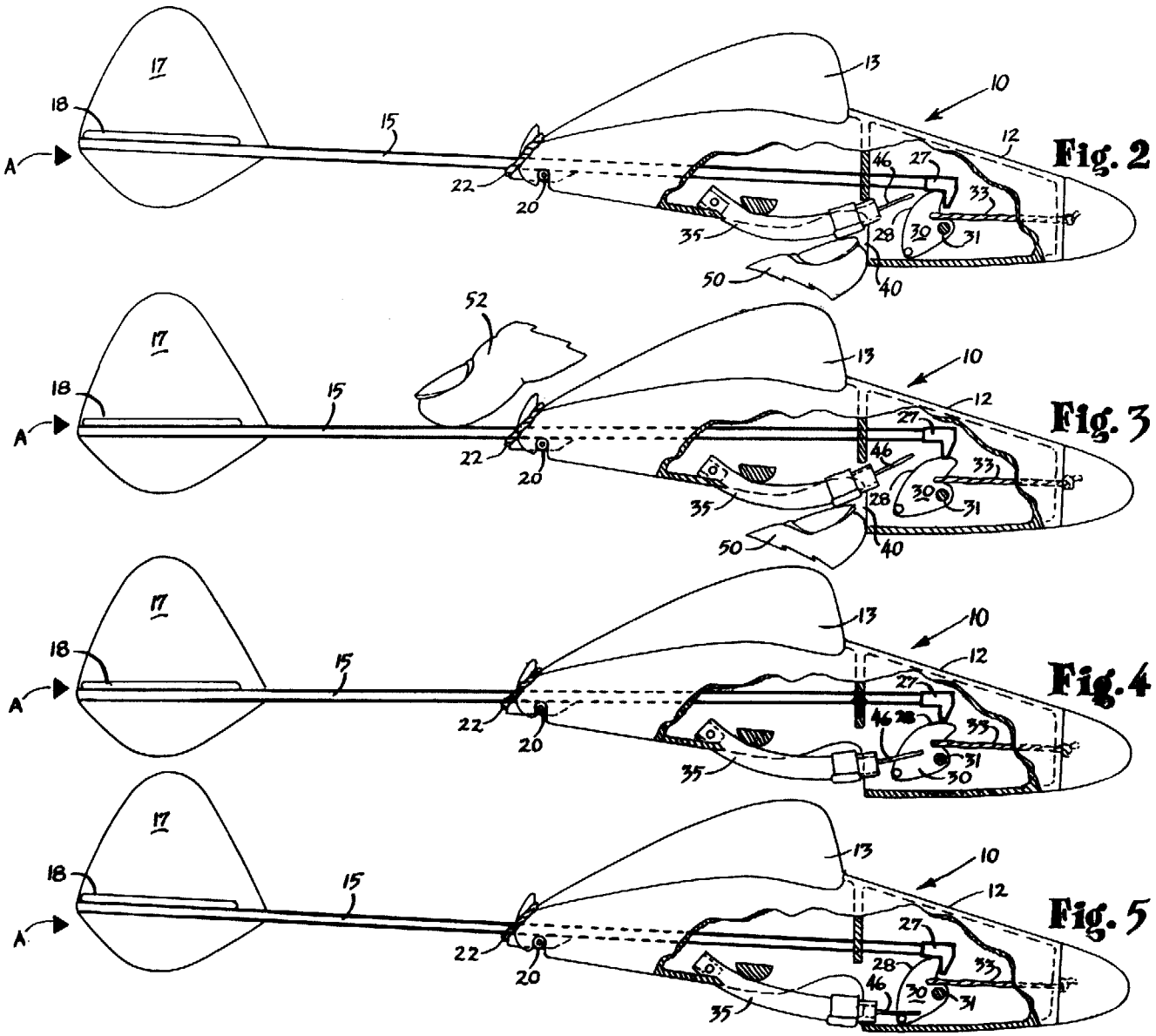
FIG. 2 is a partially sectioned view of the glider embodiment shown in FIG. 1 in a prelaunch configuration.
FIG. 3 is a partially sectioned view of the glider embodiment shown in FIG. 1 in a launch configuration.
FIG. 4 is a partially sectioned view of the glider embodiment shown in FIG. 1 in the "launch" phase configuration.
FIG. 5 is a partially sectioned view of the glider embodiment shown in FIG. 1 in a "glide" configuration.
Figure 6:
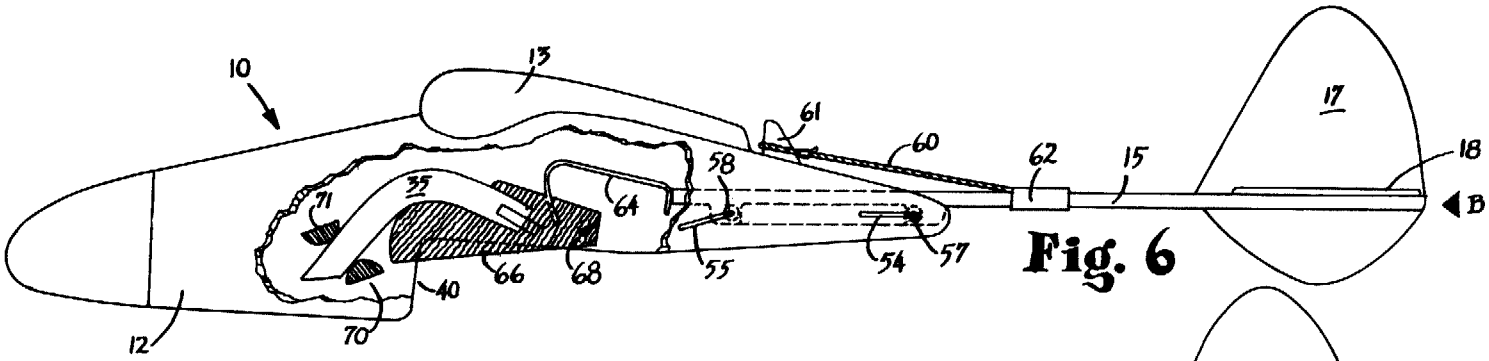
FIG. 6 is a simplified, sectioned view of another embodiment of a glider according to the instant invention in a launch configuration.

As shown in FIG. 2, glider 10 is intended to be grasped with user's finger 50—or a catapult member—extending into notch 40 thereby upwardly displacing distendable member 35. As can be noted by index mark A, in FIG. 2, glider 10 is configured with pitch attitude boom 15 in a glide mode, i.e., with horizontal elevator 18 in a relatively upward position. Follower 27 is in a released, downward configuration as a result of the orientation of activation means 30 and the pull of biasing means 22.

As shown in FIG. 3, when pressure is exerted by the user, i.e., through finger 52, pitch attitude boom 15 and attached follower 27 move upward thereby releasing the latching of activation means 30 around pivot rod 31 to support follower 27 on release service 28 thereby, as can be seen with reference to index mark A, configuring glider 10 in a launch configuration, i.e., with horizontal stabilizer 18 in a relatively neutral position.

Upon launch, as shown in FIG. 4, distendable member 35 is released and, as a result of its elastic memory, slowly regains its relaxed position. Thus, as in FIG. 4, during the launch phase the glider 10 is properly configured for a high velocity, high kinetic energy launch for an efficient climb to altitude and, upon loss of speed, for the nose of glider 10 to fall. Thereafter, as shown in FIG. 5, shaft 46 protruding axially from distendable member 35 contacts engagement member 48 of activation means 30 thereby overcoming the bias of positioning means 33 and rotating activation means 30 around pivot rod 31 and permitting release surface 28 to rotate out from under follower 27 with the resulting relocation of follower 27 and attached pitch attitude boom 15. When release surface 28 permits downward movement of follower 27, biasing means 22 urges pitch attitude control boom 15 into an upward location thereby positioning horizontal elevator 15 in the glide position as can again be seen with reference to index mark A.

Summarily, with reference to the glider embodiment of FIGS. 1 through 5, glider 10 is launched by first inserting finger 50, or other catapult means, into notch 40 to dislocate distendable member 35, as shown in FIG. 2. Thereafter, boom 15 is moved downward until follower 27 is supported on release surface 28. Upon launching, with pitch attitude control boom 15 in the downward or launch configuration, glider 10 is catapulted upward in the configuration shown at FIG. 4. At the time that the launch kinetic energy is expended and glider 10 moves to the top of an arcuate path, distendable member 35 releases follower 27 thereby reconfiguring horizontal stabilizer 18 into an efficient glide mode at the time that the glider 10 is otherwise in a proper attitude to assume the glide mode, i.e., having gone through the top of the launch arc and having relatively low but adequate velocity to maintain an efficient glide.

Figure 7:
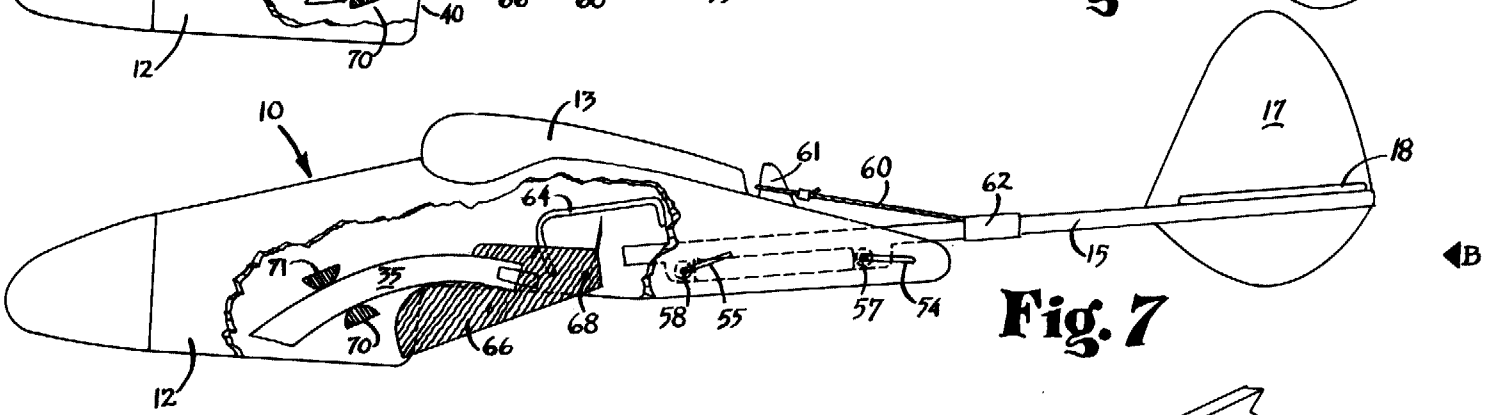
FIG. 7 is a partially sectioned cutaway of the glider of FIG. 6 in the glide configuration.
Figure 9:
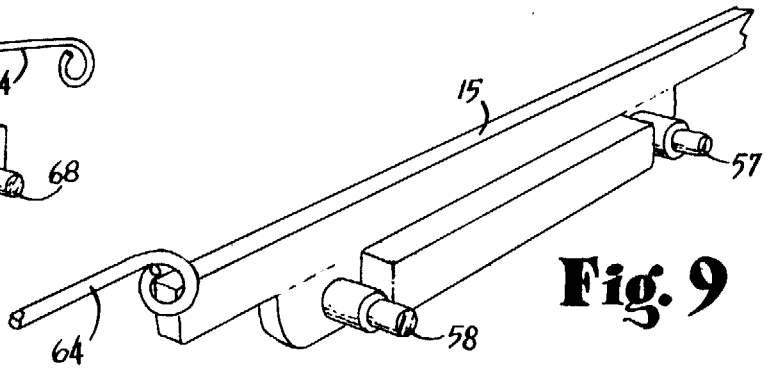
FIG. 9 is a detailed, cutaway view of a portion of the pitch attitude control structure of the glider of FIGS. 6 and 7.
Figure 8:
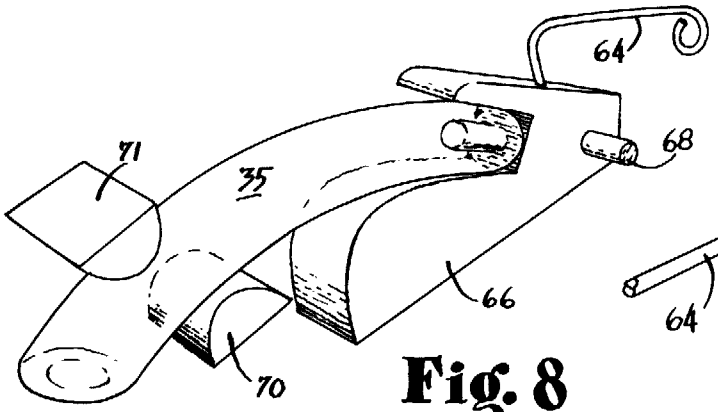
FIG. 8 is a detailed view of the timing device of the glider of FIGS. 6 and 7.

Another related embodiment of glider 10 which utilizes distendable member 35 as timer 34 is illustrated in FIGS. 6 through 9. In this embodiment, pitch attitude control boom 15 is carried in slots 54 and 55, defined in fuselage 12 by means of complimentary pins 57 and 58 projecting from attitude control boom 15. Biasing means 60 urge attitude control boom 15 forward as a result of being elastically stretched between attachment to fuselage 12 at projection 61 and attached to boom 15 by band 62. Latch member 64 depending from finger piece 66 holds boom 15 towards the rearward end of slots 55 and 54 in the configuration shown in FIGS. 6 and 9. Finger piece 66 is pivoted to fuselage 12 at pivot 68. As shown in FIG. 8, guides 70 and 71 hold distendable member 35 in a position tending to rotate finger piece 66 around pivot 68 until, as shown in FIG. 7, latch member 64 is urged out of contact with the end of boom 15 thereby pivoting pins 57 and 58 to slide forward in slots 54 and 55 and, accordingly, reconfiguring horizontal elevator 18 into an upward glide configuration. The change in the relationship of horizontal elevator 18 between the configurations of FIG. 6 and FIG. 7 will be apparent with reference to index mark B.

Figure 11:
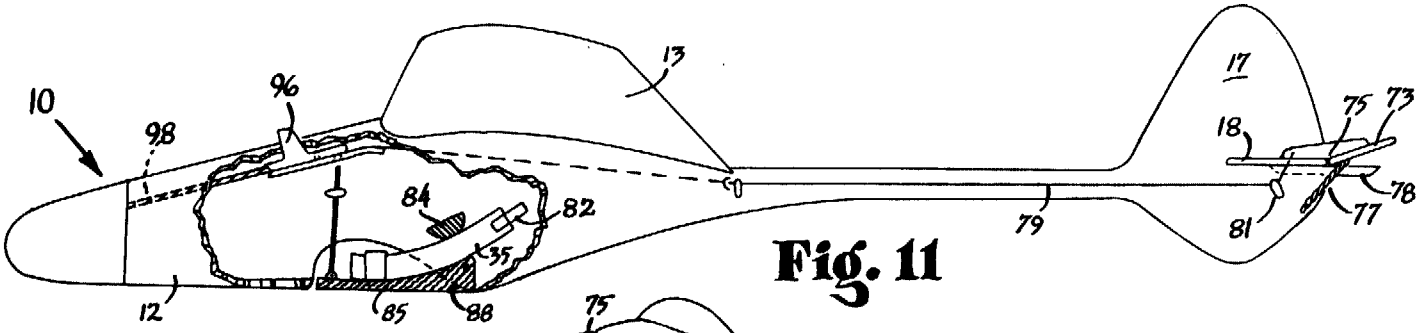
FIG. 11 is a sectioned side view of the glider of FIG. 10 in the glide configuration.
Figure 13:
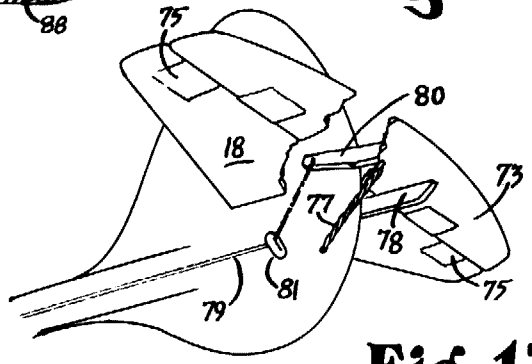
FIG. 13 is a perspective view of the pitch attitude control device of the glider of FIGS. 10 and 11.
Figure 12:
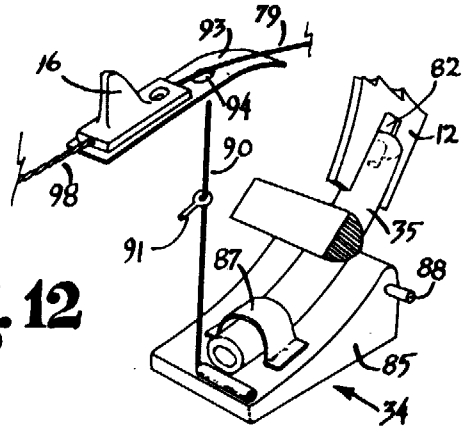
FIG. 12 is a detailed view of the timing device of the glider of FIGS. 10 and 11.

Another of the numerous embodiments within the purview of the instant invention is illustrated in FIGS. 11 through 13. In this embodiment, glider 10 is formed of fuselage 12 having horizontal stabilizer 18 fixedly attached relative to wings 13. However, elevator 73 is pivotally attached to horizontal stabilizer 18 at hinge 75 and urged downward by biasing means 77. Biasing means 77 pulls against cable 79 through arm 80 attached at one end to elevator 73 and at the other end to cable 79. Stop 78 limits the downward travel of elevator 73 and positions elevator 73 in the launch position. Cable 79 is routed through locating member 81 to position cable 79 to rotate arm 80 around hinges 75.

Figure 10:
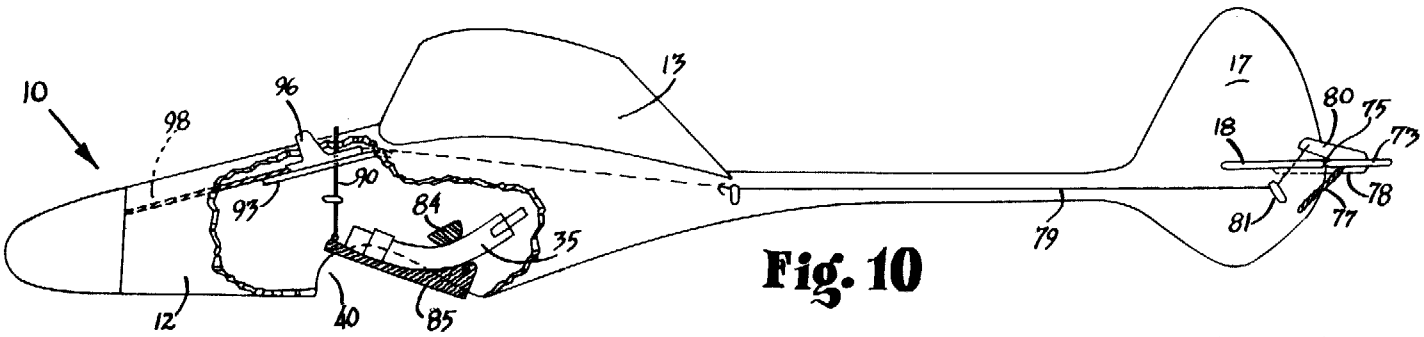
FIG. 10 is a sectioned, side view of another embodiment of a glider in accordance with the instant invention in the launch configuratiion.

Cable 79 is also releasably secured to timing means 34 shown in FIGS. 10, 11 and 12, and in particular detail in FIG. 12. Timing means 34 comprises distendable member 35 attached to fuselage 12 through securing means 82. Guide member 84 depending from fuselage 12 also locates distendable member 35. At the portion of distendable member 35 opposite that attached by securing means 82, finger piece 85 is attached by means of loosely fitting band 87 to distendable member 35. Also, finger piece 85 is pivotally attached to fuselage 12 by pivot 88.

Upright 90 is attached to finger piece 85 and located by eyelet 91. As shown in FIG. 10, upright 90 is positioned to engage latch means 93 at opening 94 defined therein. Also attached to latch means 93 are cable 79, positioning member 96 and locating means 98 in the form of an elastic strand.

In operation, as shown in FIG. 10, when finger piece 85 is displaced upward by means of a launch member (not shown) inserted in notch 40 defined in fuselage 12, upright 90 engages latch means 93 through of opening 94 defined therein. This positions elevator 73 in an essentially neutral position as the result of biasing means 77 urging elevator 73 downward against stop 78 as a result of the rearward displacement of latch means 93, inducing slacking in cable 79. Again, upon launch, distendable member 35 is permitted to slowly return to its relaxed position thereby rotating finger piece 85 around pivot 88, as shown in FIG. 11, and withdrawing upright 90 from opening 94. Thereupon, as shown in FIGS. 11 and 13, locating member 98, in the form of an elastic strand, induces through latch means 93 and cable 79, a force upon arm 80 to overcome biasing means 77 thereby urging elevator 73 into an upward or glide configuration. The result of this timed reconfiguration of elevator 73 is as discussed above.

To reconfigure glider 10 to the launch mode shown in FIG. 10, finger piece 85 is again rotated around pivot 88 into an upward position and latch means 93, with the aid of positioning member 96 protruding through the top of fuselage 12, is positioned to receive upright 90 through opening 94. Thus, until glider 10 is launched and distendable member 35 released to slowly withdraw upright 90 from opening 94, the glider 10 is maintained in the launch configuration of FIG. 10.

Summarily, the instant invention involves a method in which a glider is launched with the pitch attitude control means in an essentially neutral position. This permits the glider, even when traveling at substantial velocity upon launch, to travel essentially linearly with the lifting surface at a low angle of attack. As the launch speed decreases, the glider follows an arcuate path while gaining appreciable height. The glider then passes approximately through the top of the launch arc and when the altitude is greatest and velocity minimal but still adequate to maintain stable flying conditions, the pitch attitude control means is repositioned to an upward configuration to present the lifting surface at a greater angle of attack thereby providing for slower and more efficient gliding of the glider.

The method is accomplished by utilizing a timing device in conjunction with means to reposition the pitch attitude control means. Thus, as the glider approaches the ideal configuration and speed initiating a glide, the timing device reconfigures the pitch attitude control means to the glide configuration.

The timing device has been described in terms of the most desirable distendable member, but obviously other invention timing devices such as a spring loaded escapement, highly dampened spring or dashpot could also be utilized.

Although several embodiments of the present invention have been illustrated and described, it is anticipated that numerous changes and modifications will be apparent to those skilled in the art, and that such changes may be made without parting from the scope of the invention as defined by the following claims.

What is claimed is:

1. A model glider comprising:

a fuselage having attached thereto fixed configuration lift surfaces and movable pitch attitude control means;

means for moving the pitch attitude control means; and timing means positioned to activate the means for moving the pitch attitude control means after a preselected period of time, whereby, the pitch attitude control means may be initially set in a relatively neutral position and, after launching the glider and allowing it to attain altitude, the timing means may activate the means for moving the pitch attitude control means to reconfigure the pitch attitude control means into a substantial upward configuration to provide an efficient glide.

2. A model glider as set forth in claim 1 in which the means for moving the pitch attitude control means comprise:

latch means operatively connected to and securing the pitch attitude control means in a first position, the latch means being located adjacent the timing means to be released by the timing means; and biasing means urging the pitch attitude control means into a second position upon release of the latch means by the timing means.

3. A model glider as set forth in claim 2 in which the timing means comprise:

a distendable member having elastic memory secured in a cantilevered manner to the glider and positioned to be temporarily displaced, whereby the displaced movable member having elastic memory will return to its original configuration after a preselected period of time and contact the latch means to release the pitch attitude control means and permit the biasing means to move the pitch attitude control means to a second position.

4. A model glider as ser forth in claim 1 in which the pitch attitude control means comprise:

a horizontal stabilizer fixedly carried on a boom movably attached to the fuselage.

5. A model glider as set forth in claim 1 in which the pitch attitude control means comprises:

a fixed horizontal stabilizer attached to the glider fuselage and a movable elevator pivotally attached to the fixed horizontal stabilizer.

6. A model glider as set forth in claim 1 in which the pitch attitude control means comprise:

a boom pivotally attached to the fuselage and carrying a fixed horizontal stabilizer;

the means for moving the pitch attitude control means comprise resilient biasing means urging the boom into an upward position, a latch comprising eccentric activation means pivotally attached to the fuselage adjacent the terminus of the boom opposite that carrying the horizontal stabilizer and supporting a follower supported on such boom terminus; the activation means being biased to a position supporting the follower and boom in a neutral position; and the timing means comprise a distendable member having elastic memory attached at one end to the glider fuselage and cantilevered from such attachment to a position adjacent the activation means to engage the activation means and rotate the activation means to a position releasing the follower to contact a smaller diameter portion of the eccentric activation means thereby permitting the biasing means to urge the boom around its pivot to move the horizontal stabilizer on the boom to an upward configuration.

7. A model glider as set forth in claim 1 in which, the pitch attitude control means comprise a boom carrying a fixed horizontal stabilizer and attached by pins extending from the boom one each into one of two spaced and skewed slots having substantial horizontal components defined in the fuselage; the means for moving the pitch attitude control means comprising resilient biasing means urging the boom into a forward position in the slots with, as a result of the skewness of the slots, the resulting positioning of the horizontal stabilizer in an upward configuration, and latch means in the form of a latch member engaging the terminus of the boom to position the boom in a rearward relationship relative to the slots with the horizontal elevator in a substantially neutral position; and the timing means comprising a distendable member having elastic memory carrying the latch member, the distendable memory being movable to engage the latch member with the boom terminus but, in the relaxed position, positioning the latch member in a spaced apart relationship with the boom terminus to permit the biasing means to move the boom to the forward configuration.

8. A model glider as set forth in claim 1 in which, the pitch attitude control means comprise an elevator pivotally attached to a fixed horizontal stabilizer carried on the fuselage;

the means for moving the pitch attitude control means comprise an arm extending from the movable elevator, a cable connected to the arm, biasing means connected between the cable and the fuselage to urge the cable, arm and ultimately the elevator into an upward position, a latch member having an opening defined therein positioned between the biasing means and the cable, an upright member positioned to engage the opening and position the elevator in a substantially neutral position and resilient means attached to the elevator and urging the elevator downward; and the timing means comprising a distendable member having elastic memory attached to the fuselage and carrying the upright member, the distended member in a stressed orientation positioning the upright in the opening and in a relaxed position withdrawing the upright from the opening, whereby the glider may be launched with the distendable member positioning the upright in the opening and securing the elevator in a neutral position and, after a predetermined length of time, the distendable member will slowly move from the stressed to the relaxed position, thereby withdrawing the upright from the opening and permitting the biasing means to, through the cable, position the elevator in an upward orientation.

9. A model glider comprising:

a fuselage having attached thereto wings and movable pitch attitude control means;

biasing means urging the pitch attitude control means into an upward configuration;

releasable latch means operably connected to the pitch attitude control means to releasably latch the movable pitch attitude control means in a neutral configuration; and timing means positioned adjacent the latch means to contact and release the latch means a predetermined length of time after activation of the timing means, whereby the glider may be launched with the pitch attitude control means latched in the neutral position and reconfigured to an upward position in flight when the timing means releases the latch means.

10. A model glider as set forth in claim 9 in which the timing means comprise an elongated distendable member having elastic memory attached to the glider in a cantilevered fashion and displaceable to permit the latch means to be engaged but, as a result of the elastic memory, being biased to resume the original position to contact and release the latch means.

11. A method of flying a model glider having a fuselage with attached lift surfaces and movable pitch attitude control means, means for moving the pitch attitude control means, and timing means to activate the pitch attitude control means after a preselected period of time comprising:

positioning the pitch attitude control means in a first, substantially neutral configuration;

launching the glider and concurrently triggering the timing means;

causing the timing means to activate the means for moving the pitch attitude control means a preselected period of time after launching by moving the pitch attitude control means to a second, substantially upward position, upon activation of the means to move the pitch attitude control means, whereby the glider is launched in a neutral configuration appropriate to launching speeds, and, after the preselected period of time, reconfiguring the glider to a configuration appropriate for extended gliding.

* * * * *

UNITED STATES PATENT OFFICE

CERTIFICATE OF CORRECTION

PATENT NO. : 3,995,393

DATED : December 7, 1976

INVENTOR(S) : Douglas Edward Patterson

It is certified that error appears in the above-identified patent and that said Letters Patent are hereby corrected as shown below:

Column 1, line 17, correct "accodingly" to --accordingly--.

Column 1, line 33, correct "a" to --at--.

Column 7, line 12, correct "ser" to --set--.

Signed and Sealed this

Twenty-second Day of February 1977

[SEAL]

*Attest:*

RUTH C. MASON
*Attesting Officer*

C. MARSHALL DANN
*Commissioner of Patents and Trademarks*